US005437579A

United States Patent [19]

Salvino

[11] Patent Number: 5,437,579

[45] Date of Patent: Aug. 1, 1995

[54] SPIN AXIS WEIGHTED BOWLING BALL

[76] Inventor: Carmen M. Salvino, 65 Stevens Dr., Schaumburg, Ill. 60173

[21] Appl. No.: 739,109

[22] Filed: Aug. 1, 1991

Related U.S. Application Data

[63] Continuation-in-part of Ser. No. 540,838, Jun. 20, 1990, Pat. No. 5,058,901.

[51] Int. Cl.[6] ..... A63B 37/06

[52] U.S. Cl. ..... 473/126

[58] Field of Search ..... 273/63 E; 473/126

[56] References Cited

U.S. PATENT DOCUMENTS

| | | | |
|---|---|---|---|
| 189,674 | 4/1877 | Woods | 273/63 A |
| 447,011 | 2/1891 | Harman | 273/63 A |
| 533,011 | 1/1895 | Huntoon | 273/63 A |
| 580,207 | 4/1897 | Boemermann et al. | 273/63 A |
| 626,584 | 6/1899 | Wilmerling | 273/63 A |
| 673,688 | 5/1901 | Pickett | 273/63 A |
| 712,192 | 10/1902 | Immen | 273/63 A |
| 746,576 | 12/1903 | Rice | 273/63 A |
| 950,838 | 3/1910 | Cavanagh | 273/63 A |
| 1,021,490 | 3/1912 | Scully | 273/63 A |
| 1,217,940 | 3/1917 | Hill | 273/63 A |
| 2,273,199 | 2/1942 | Hilton et al. | 273/63 A |
| 2,291,738 | 8/1942 | Luth et al. | 273/63 E |
| 2,362,269 | 11/1944 | Hall | 273/63 E |
| 2,393,026 | 1/1946 | Dietz et al. | 273/63 A |
| 2,414,672 | 1/1947 | Sauer | 273/63 E |
| 2,839,301 | 6/1958 | Hunter | 273/63 E |
| 3,270,108 | 8/1966 | Randolph | 264/162 |
| 3,329,429 | 7/1967 | Kopperkud | 273/63 A |
| 3,441,274 | 4/1969 | Collins | 273/63 E |
| 3,865,369 | 2/1975 | Randolph | 273/63 E |
| 4,121,828 | 10/1978 | Amburgey | 273/63 E |
| 4,150,822 | 4/1979 | Beckman | 273/63 B |
| 4,183,527 | 1/1980 | Amburgey | 273/63 E |
| 4,320,899 | 3/1982 | Salvino | 273/63 E |
| 4,523,757 | 6/1985 | Swett et al. | 273/63 E |
| 4,913,429 | 4/1990 | Fabanich | 273/63 E |
| 5,037,096 | 8/1991 | Pinel et al. | 273/63 E |
| 5,058,901 | 10/1991 | Salvino | 273/63 C |
| 5,257,806 | 11/1993 | Linden | 473/126 |

FOREIGN PATENT DOCUMENTS

| | | | |
|---|---|---|---|
| 108100 | 7/1917 | United Kingdom | 273/63 E |

*Primary Examiner*—George J. Marlo

*Attorney, Agent, or Firm*—Fay, Sharpe, Beall, Fagan, Minnich & McKee

[57] ABSTRACT

A bowling ball having thumb and finger holes for gripping said ball, said ball having a geometric center and when thrown consistently having a ball track plane and a spin axis, said spin axis being perpendicular to said ball track plane, said ball comprising:

a first weighting means located within said ball along said spin axis on a positive side of said ball, said first weighting means having a weight of $W_1$ and being located a distance $D_1$ from said geometric center; and, a second weighting means located within said ball along said spin axis, said second weighting means having a weight $W_2$ and being located a distance $D_2$ from said geometric center, $W_1$ being greater than $W_2$, $D_1$ being less than $D_2$, said first and second weighting means being on opposite sides of said geometric center along said spin axis, said first and second weighting means placed along said spin axis so that $W_1D_1=W_2D_2$.

2 Claims, 7 Drawing Sheets

FIG. 2
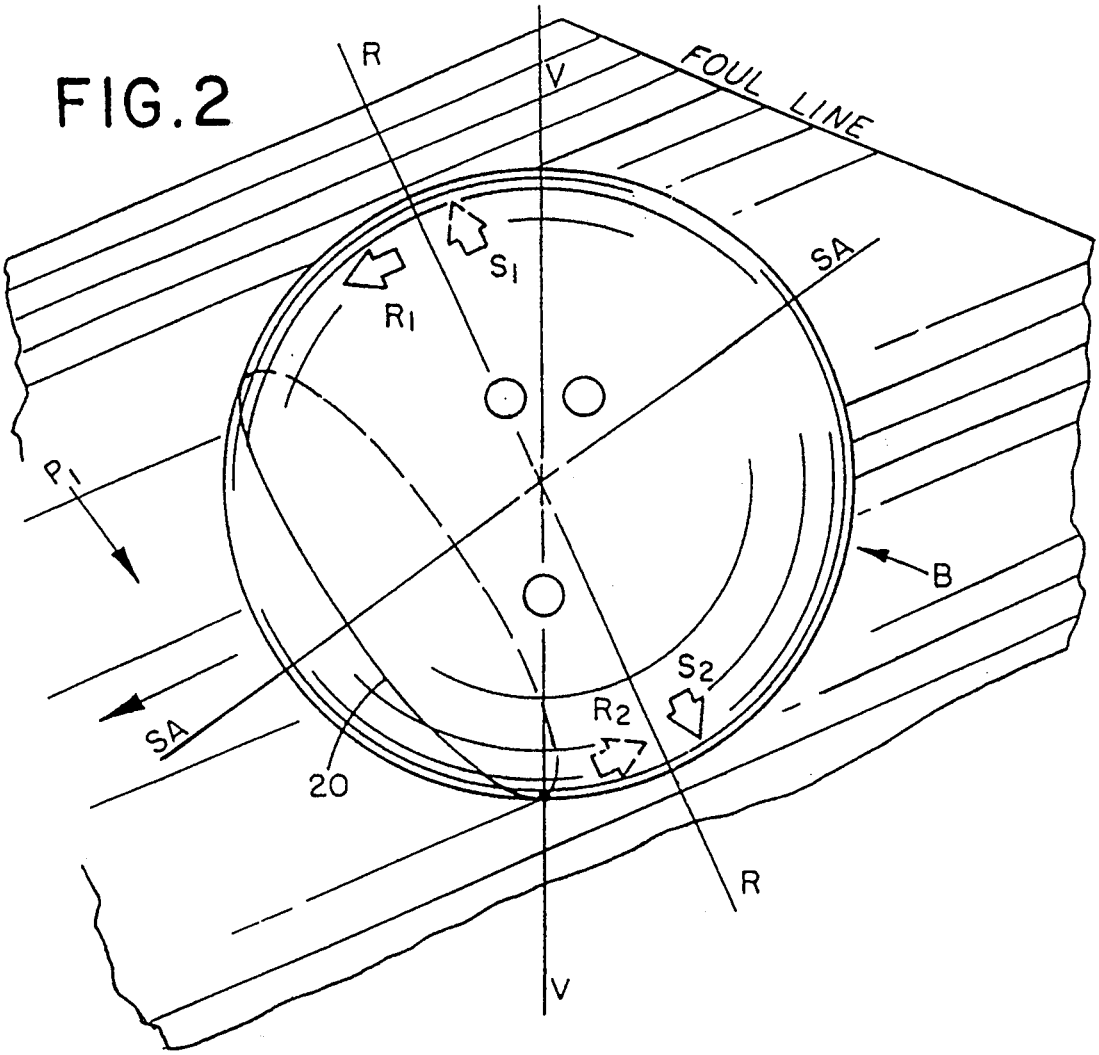
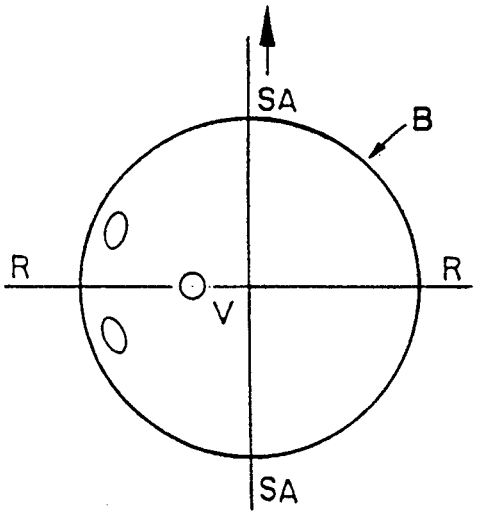
FIG. 3
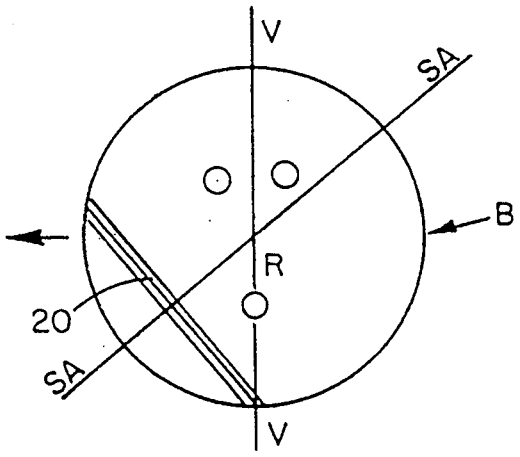
FIG. 4

SPIN AXIS WEIGHTED BOWLING BALL

CROSS REFERENCE TO RELATED APPLICATIONS

This application is a continuation-in-part of U.S. application Ser. No. 07/540,838, filed Jun. 20, 1990, now U.S. Pat. No. 5,058,901.

BACKGROUND OF THE INVENTION

I. Field of Invention

This invention pertains to the art of sporting balls thrown or rolled by hand, and more particularly to bowling balls having weights situated along the spin axis of the ball.

II. Description of Related Art

Many games and sports popularly enjoyed by enthusiasts require the use of a hand-held ball which is rolled or thrown. Among these games is that of bowling. The bowling ball which is in popular use in the United States must meet rigid standards promulgated by the American Bowling Congress. Among these standards is the requirement that the weight of the bowling ball must not exceed sixteen pounds and the weight of the ball must not differ more than one ounce from side to side and more than three ounces from top to bottom. Further, the outside diameter of the bowling ball must be between 8.550 and 8.590 inches.

Bowling balls are commonly drilled to provide grips for the bowler. When the ball is drilled, material is removed from the ball. This can create an unbalanced condition which can be detrimental to the ball's performance. On the other hand, to some skilled bowlers, a slight imbalance can be advantageous, modifying the trajectory of the ball down the bowling alley or in the manner in which it impacts the pins.

It is a general object of this invention to provide a bowling ball which includes weights on the spin axis of the bowling ball and which have certain properties and positions relative to the center of the ball so that the stability of the ball as it spins down the lane is improved.

SUMMARY OF THE INVENTION

In accordance with the present invention, a new and improved bowling ball is provided which features weighting means along the spin axis of the bowling ball.

More particularly, in accordance with the invention, a bowling ball has thumb and finger holes for gripping the ball. The ball also has a geometric center and, when thrown consistently, a ball track plane. A spin axis is perpendicular to the ball track plane. A first weighting means is located within the ball on the spin axis. The first weighting means has a mass $M_1$ and is positioned a distance $D_1$ from the geometric center. A second weighting means is located within the ball on the spin axis and has a mass $M_2$ and is positioned a distance $D_2$from the geometric center. The geometric center is located on the spin axis between the first and second weighting means. The first and second weighting means are positioned so that moments of the first and second weighting means about the geometric center which are created by forces acting on the ball are approximately equal to zero.

According to another aspect of the invention, a first force $W_1$ acts on the first weighting means in a magnitude equal to gravitational acceleration multiplied by $M_1$ and having a direction generally toward the center of the earth. A second force $W_2$ acts on the second weighting means with a magnitude equal to the gravitational acceleration multiplied by $M_2$ in a direction generally toward the center of the earth.

In accordance with another aspect of the invention, the bowling ball is substantially statically balanced but is dynamically unbalanced.

In accordance with another aspect of the invention, a first moment $T_1$ of the first weighting means about the geometric center is equal to $T_1=M_1D_1G$ and a second moment of the second weighting means about the geometric center is equal to $T_2=M_2D_2G$ the second moment $T_2$ being substantially equal to the first moment $T_1$.

According to a still further aspect of the invention, a first moment of inertia $I_1$ of the first weighting means about the geometric center is equal to $I_1=M_1D_1^2$ and a second moment of inertia of the second weighting means about the geometric center is equal to $I_2=M_2D_2^2$, the second moment of inertial being substantially unequal to the first moment of inertia.

One advantage of the present invention is the provision of weighting means on the spin axis which tends to lower the bowling ball's moment of inertia about the spin axis. This results in a more stable trajectory and a lessening of dynamic imbalance during the spinning phase of the ball's trajectory down the bowling lane.

Another advantage of the present invention is the provision of unequal weighting means on either side of the geometric center of the ball along the spin axis. The unequal weighting means, each located a different distance from the geometric center of the ball, allow the ball to fall within standards promulgated by the American Bowling Congress for static balance, yet create a dynamically unbalanced condition. This can improve the ball's trajectory down the lane and provide better hitting power when the ball impacts the pins. By placing the heavier side of the spin axis on the positive side of the bowling ball, the ball hits the pocket with more advantageous results.

Still other benefits and advantages will become apparent to those skilled in the art upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein:

FIG. 2 is a schematic perspective partially cross sectional view of a bowling ball and weighting means according to the present invention;

FIG. 3 is a schematic top view of the bowling bowl in FIG. 2;

FIG. 4 is a schematic elevational view of the bowling ball in FIG. 2;

DESCRIPTION OF THE PREFERRED EMBODIMENT

Figure 1:
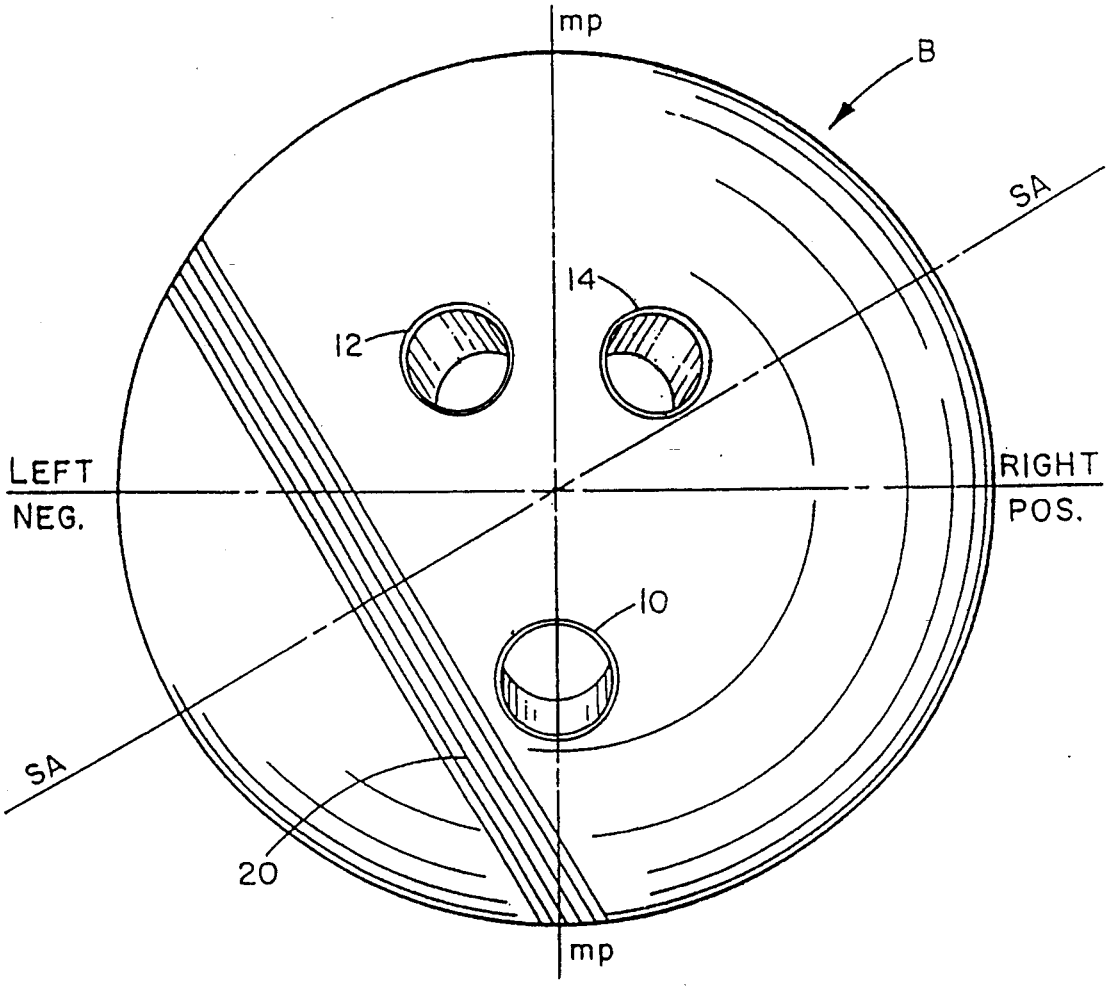
FIG. 1 is a schematic plan view of a bowling ball with a ball track.

Referring now the drawings wherein the showings are for purposes of illustrating a preferred embodiment of the invention only, and should not be understood as limiting the invention, FIG. 1 shows a typical bowling ball B which features three drilled holes. A mid-plane MP of the bowling ball B passes through the center of a thumb hole 10 and bisects a line segment between the center of a middle finger hole 12 and a ring finger 14. For a right-handed bowler, the area on the right half of the mid-plane MP is called the positive side of the ball b, while the area on the left side of the mid-plane MP is called the negative side of the ball B.

In the case where a consistent bowler uses the same bowling ball for a length of time, a distinguishing wear pattern called a ball track 20 will begin to appear. Because the ball B is spinning as it leaves the bowler's hand, and because lanes are generally oiled, the ball B tends to slide along the lane for a length of time before friction between the ball B and the .lane causes the ball B to begin rolling down the lane. The sliding of the ball B relative to the lane, causes the weave marks known as the ball track 20. The width of the ball track 20 can vary due to factors such as the consistency of the bowler and the dynamic stability of the bowling ball B. For discussion purposes, the ball track 20 can be considered as being in a plane which is centered in the middle of the ball track 20. Perpendicular to the plane containing the ball track 20 is a line called the spin axis SA. When the ball B is spinning and sliding down the lane, it revolves around the spin axis SA.

The dynamics of the motion of a bowling ball B as it travels down the bowling alley lane is described in FIGS. 2–4. When the ball B is delivered from the bowler's hand, the ball is spinning about the spin axis SA and sliding down the lane 22. Just after the ball B leaves the bowler's hand, it is usually not yet rolling. At some point down the lane 22, the ball's motion begins to change from spinning and sliding to rolling. During-this time of transition, the bowling ball is revolving about two axes simultaneously and is subject to the physical phenomenon of precession.

With continuing reference to FIGS. 2–4, the bowling ball's motion may be conveniently described with resort to three axes. The first axis, denoted SA, is the spin axis of the bowling ball B. The second axis, denoted R, passes through the center of the bowling ball and is parallel to the lane surface. This is the axis about which the bowling ball revolves as it rolls. The third axis, denoted V, is a vertical axis passing through the center of the bowling ball which is perpendicular to the rolling axis R.

Weighing a Bowling Ball

The American Bowling Congress has published general instructions for weighing and balancing bowling balls on a beam scale. In summary, the American Bowling Congress requires that a static beam balance scale be used for weighing and measuring the center of gravity CG shift in bowling balls. A non-uniform distribution of weight can cause a bowling ball to have a different apparent weight when weighed in different positions.

Figure 5:
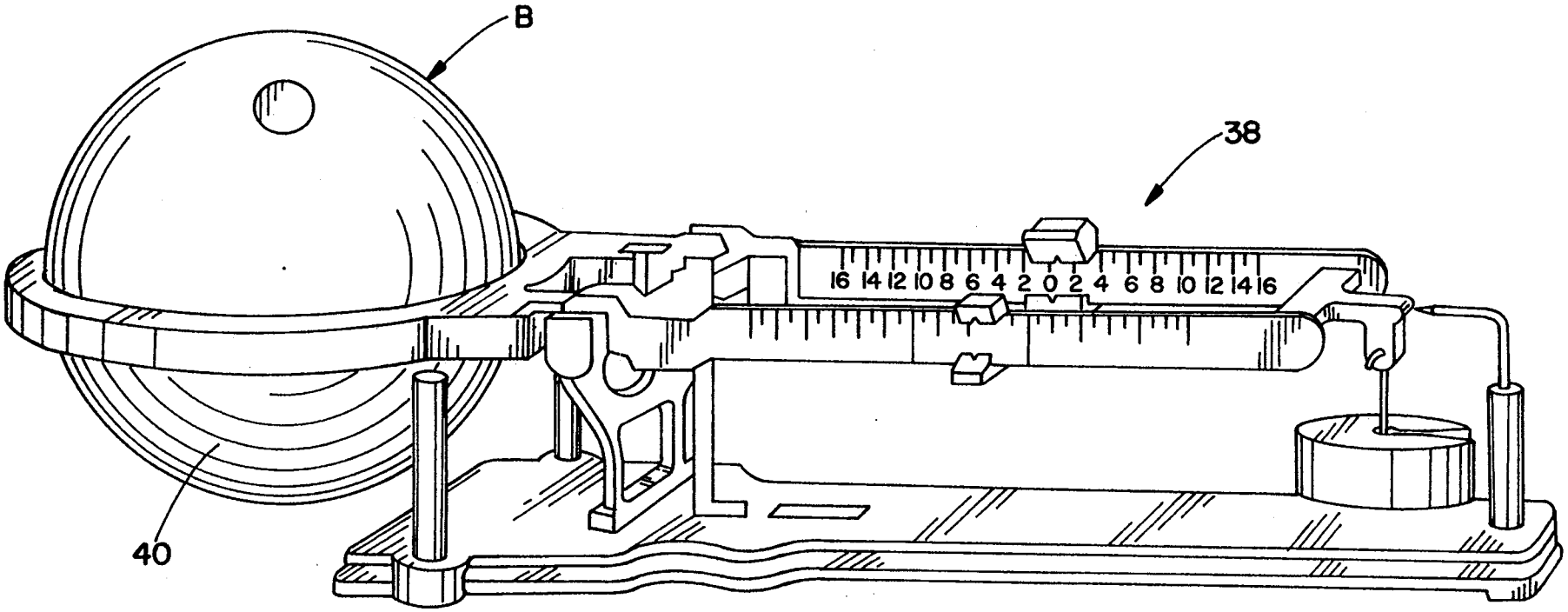
FIG. 5 is an elevational perspective view of an imbalance scale for weighing a bowling bowl.

With reference to FIG. 5, a beam scale 38 such as is specified by the American Bowling Congress for weighing bowling balls is shown. The beam scale 38 features a spherical cradle 40 for holding the bowling ball B in a fixed position relative to the pivot axis 42 of the scale 38. The ball B is placed in the spherical cradle 40 and weighed. Next, the ball B is turned within the spherical cradle 40 and a second weight reading is observed. If the exterior of the ball is reasonably spherical in shape, the difference between the first weighing and the second is the shift in the center of gravity CG for the two weighing positions.

Figure 6:
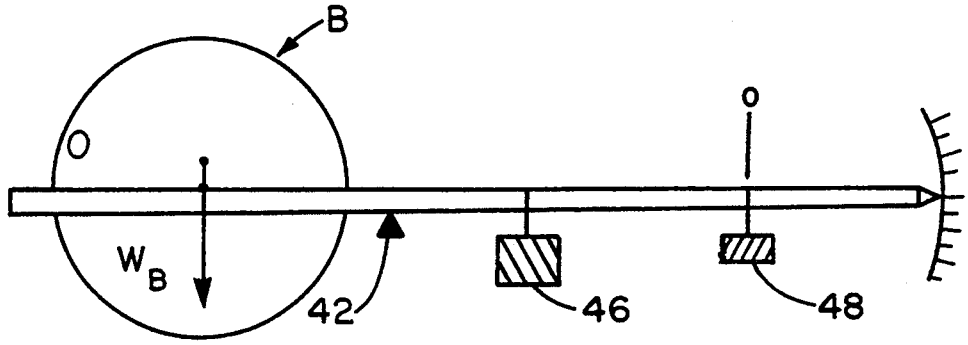
FIG. 6–11 are schematic illustrations of the beam balance of FIG. 5.
Figure 7:
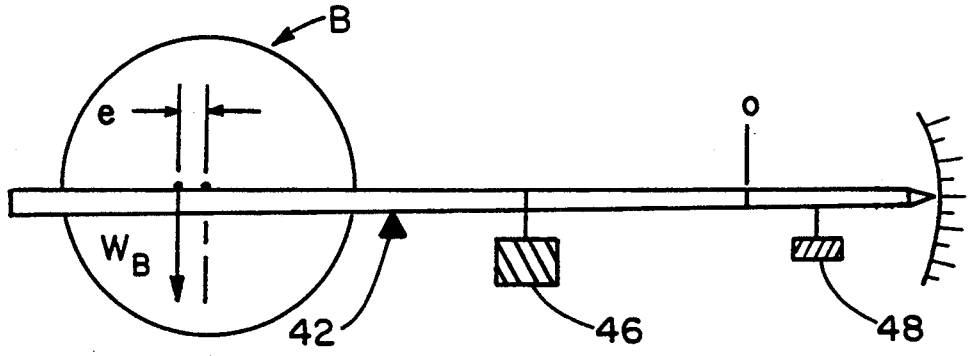
Figure 8:
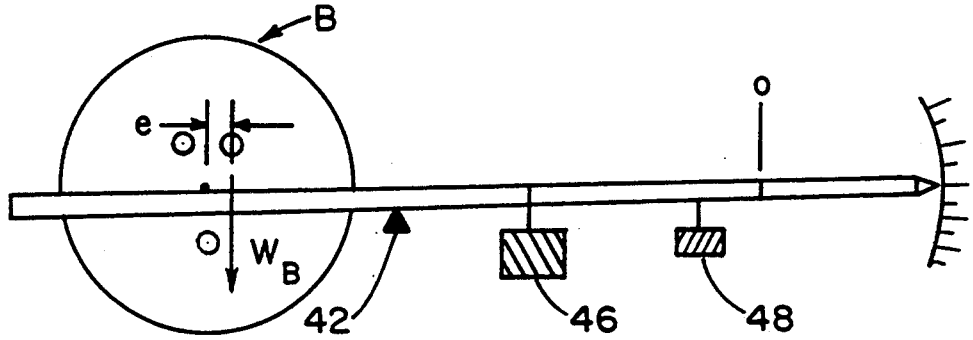

With reference to FIGS. 6–8, three schematic views of the beam balance scale 38 are shown. In FIG. 6, a ball B for which the center of gravity CG is at the geometric center C of the ball is shown. By using an air bearing or by floating the ball B in a liquid, a heavy side of the ball B can be determined if the center of gravity CG of the ball is offset from its geometric center C. In such case, the ball can be placed on the scale with the center of gravity CG in the top position. The scale is then balanced using the weight poise 46 and the balance poise 48 set to zero.

Next, the ball B is rotated 90° counterclockwise so that the ball's center of gravity CG is moved away from the pivot, causing the apparent ball weight to increase. The balance poise 48 is moved to the right, as seen in FIG. 7, to bring the scale back to a balanced condition without moving the weight poise 46. This step called "weighing the top of the ball," gives an estimate of the shift of the ball's center of gravity CG in terms of an artificial weight, which depends on the physical dimension of the scale.

Figure 9:
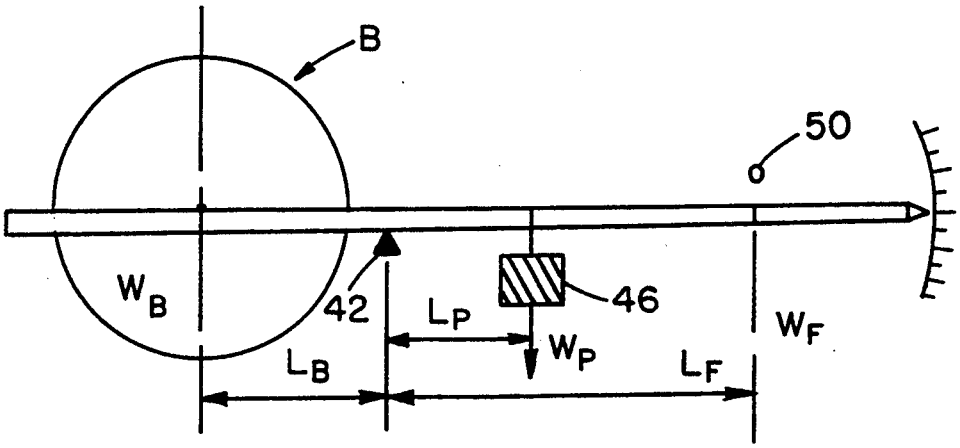
Figure 10:
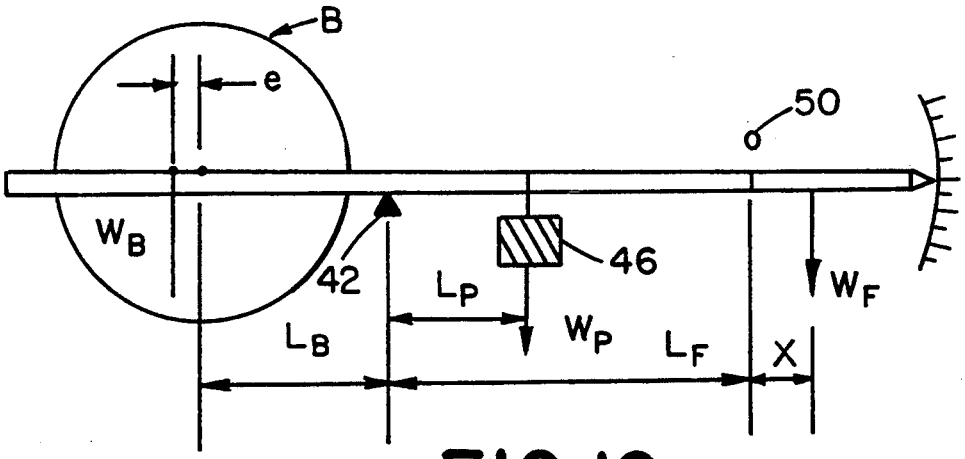
Figure 11:
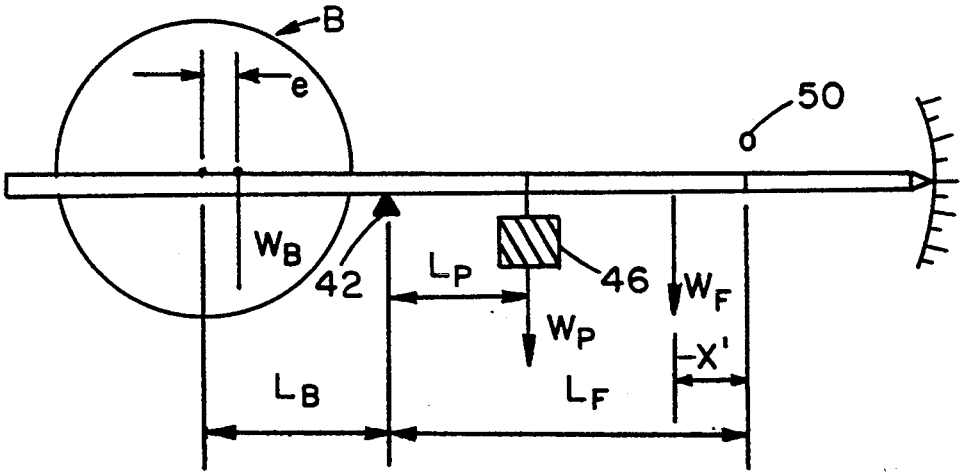
Figure 13:
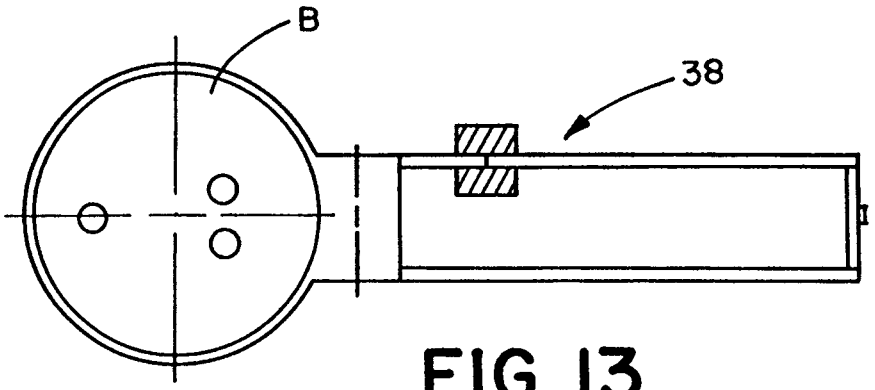
FIGS. 12–15 are schematic plan views of the beam balance of FIG. 5 illustrating the position of the bowling bowl in each of the four sides of the bowl being weighed.
Figure 12:
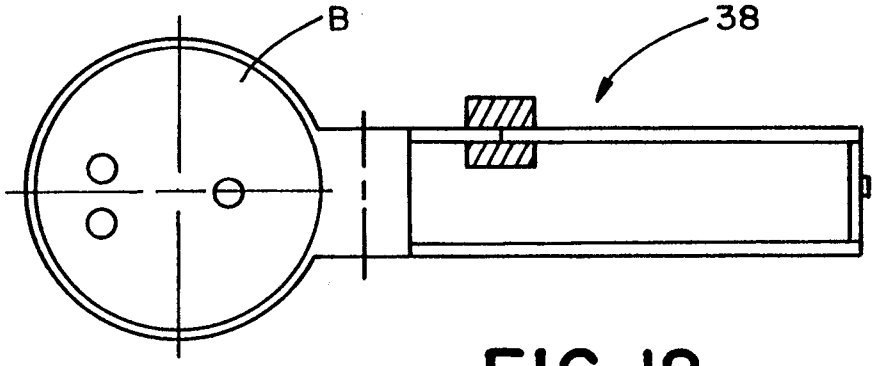
Figure 14:
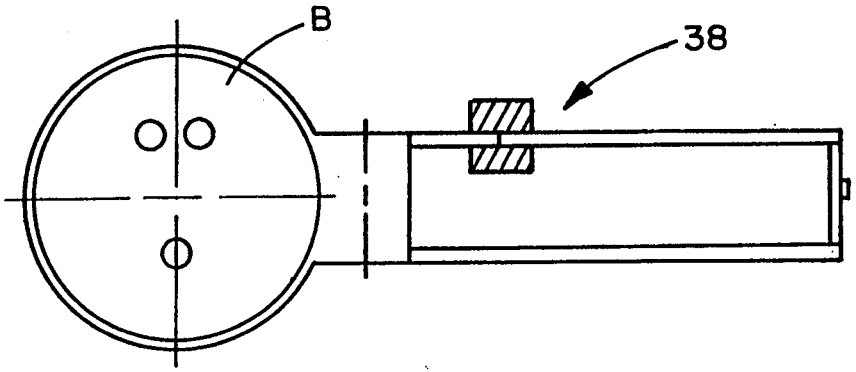
Figure 15:
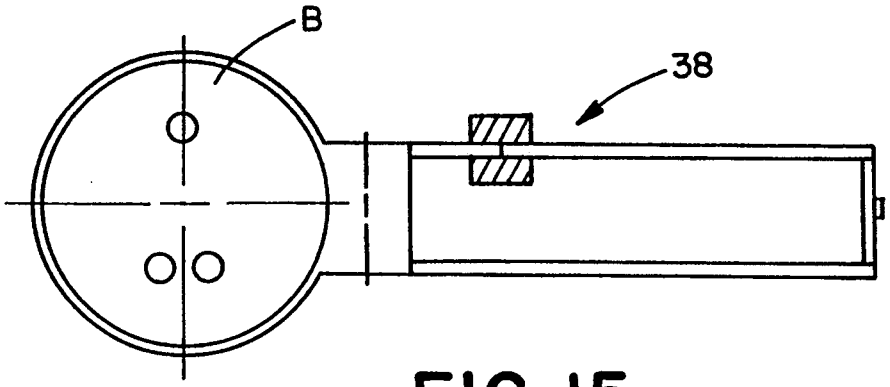

With reference to FIGS. 9–11, the following equations can be written for the two positions of the ball as discussed above: In the first position, with the ball's center of gravity CG positioned over or under the ball's geometric center C, $$W_B L_B = W_P L_P + W_F L_F$$

and in the second position, where the ball is rotated 90° counterclockwise, $$W_B(L_B + e) = W_P L_P + W_F(L_F + X)$$

where

- $W_b$ equals the weight of the ball acting at its center of gravity
- $L_B$ equals the distance between the geometric center of the ball and the pivot axis 42
- $W_P$ equals the weight of the weight poise 46
- $L_P$ equals a distance between the centroid of the weight poise 46 and the pivot axis 42
- $W_F$ equals the weight of the balance poise 48
- $L_F$ equals the distance between the centroid of the balance poise 48 and the pivot axis 42
- e equals the eccentricity of the center of gravity from the geometric center C
- x equals the distance between the centroid of the balance poise 48 and the zero point where the balance poise 48 must be located to balance the ball B when the center of gravity CG is over or under the geometric center C.

Next the ball B is rotated 180° so that the center of gravity CG is shifted toward the pivot axis 42, 90° clockwise from the first position shown in FIG. 9. This process is known as weighing the "bottom of the ball" and requires that the balance poise 48 be shifted to the left from the initial zero position 50.

Bowling balls are typically described as having six sides. With reference to FIG. 1, for a right-handed bowler, the right half of the mid-plane MP is described as the positive side of the ball and the left side of the mid-plane MP is described as the left side of the ball. The positive side of the ball B is the side which hits the head pin first. In addition, the area of the ball B near finger holes 12, 14 is described as the front or finger side of the ball B while the half of the ball B near the thumb hole is described as the back or thumb side of the ball B. In addition, the top and bottom of the ball B have already been discussed, therefore, the six sides of a bowling ball. When a bowling ball is weighed, each of the halves of the bowling ball is weighed to check for imbalance. This weighing is accomplished by turning the ball 90° within the spherical cradle 40 of the beam scale 38 and taking appropriate measurements. In FIGS. 12–15, the finger, thumb, negative, and positive sides of the bowling ball are being weighed.

Description of the Preferred Embodiment

The invention disclosed herein exploits the fact that the beam scale 38 of the American Bowling Congress is a static measurement, rather than dynamic. The bowling ball B described herein can be configured to read "balanced" on the beam scale 38 used by the American Bowling Congress, yet prove to be dynamically biased, or unbalanced, when used by the bowler. This enables the bowling ball B of the invention to fall within all requirements of the American Bowling Congress and still provide the benefits to the experienced bowler that a weight-biased bowling ball can provide.

Figure 16:
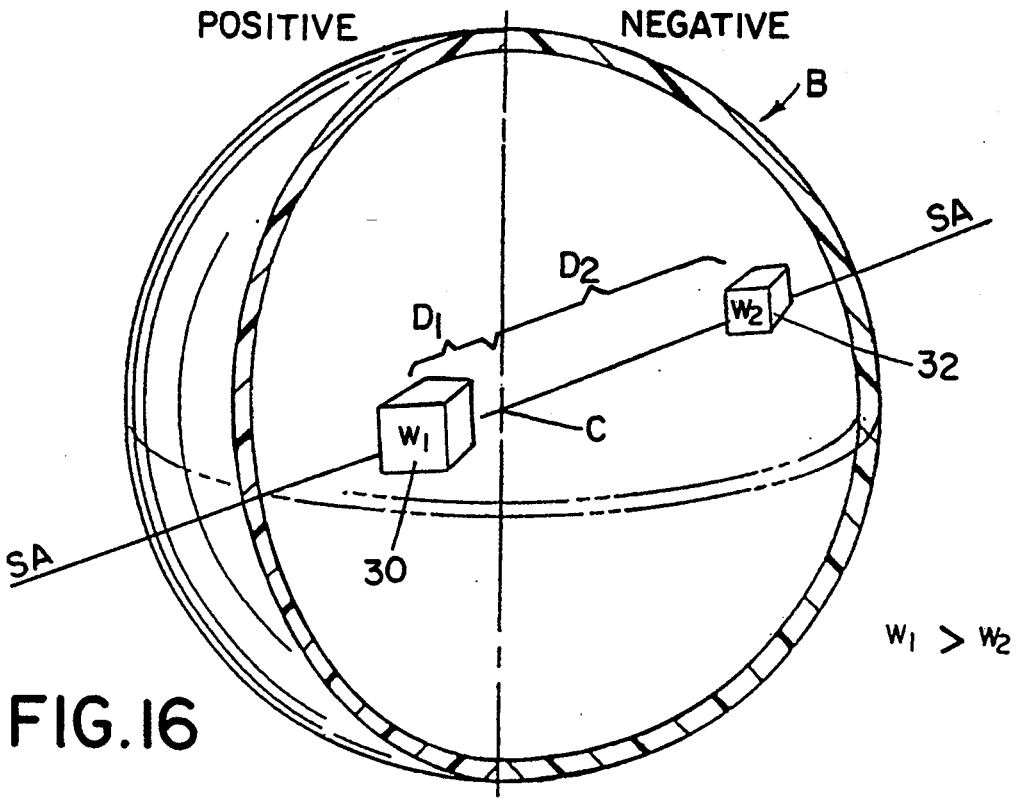
FIG. 16 is a perspective view in partial cross section of a bowling bowl according to the invention; and, FIG. 17 is a schematic perspective view in partial cross section of an alternate embodiment of the bowling bowl according to the invention.

With reference to FIG. 16, the inventive bowling ball B features a first weighting means 30 located a distance $D_1$ from the geometric center C of the bowling ball B. A second weighting means 32 is located a distance $D_2$ from the geometric center C. The first weighting means 30 has a mass $M_1$ and the second weighting means 32 has a mass $M_2$. The mass $M_1$ of the first weighting means is greater than the mass $M_2$ of the second weighting means 32. In order for the first and second masses, 30, 32 to read balanced on the beam scale 38, $D_1$ is positioned relative to $D_2$ so that $M_1D_1=M_2D_1$. This analysis is essentially causing the moment of the weight $W_1$ of the first weighting means about the geometric center C of the ball B to be equal to the moment $M_2$ of the second weighting means 32 about the geometric center C of the bowling ball B. If $M_1$, $M_2$, $D_1$, $D_2$ are chosen thusly, the ball will read balanced on the beam scale 38.

However, although the ball appears statically balanced, it can be dynamically unbalanced. For example, the moment of inertia $I_1$ about the geometric center C of the ball is equal to $M_1D_1^2$, and a second moment of inertia $I_2$ of the second weighting means 32 about the geometric center C of the ball B is equal to $M_2D_2^2$. Since the respective distance measurements, e.g., $D_1$ and $D_2$ are squared, the moment of inertial $I_2$ of the second weighting means 32 is larger than that of the first weighting means 30. This difference in moments of inertia, even though the static measurements appear equal, can lead to performance advantages to the experienced bowler.

Figure 17:
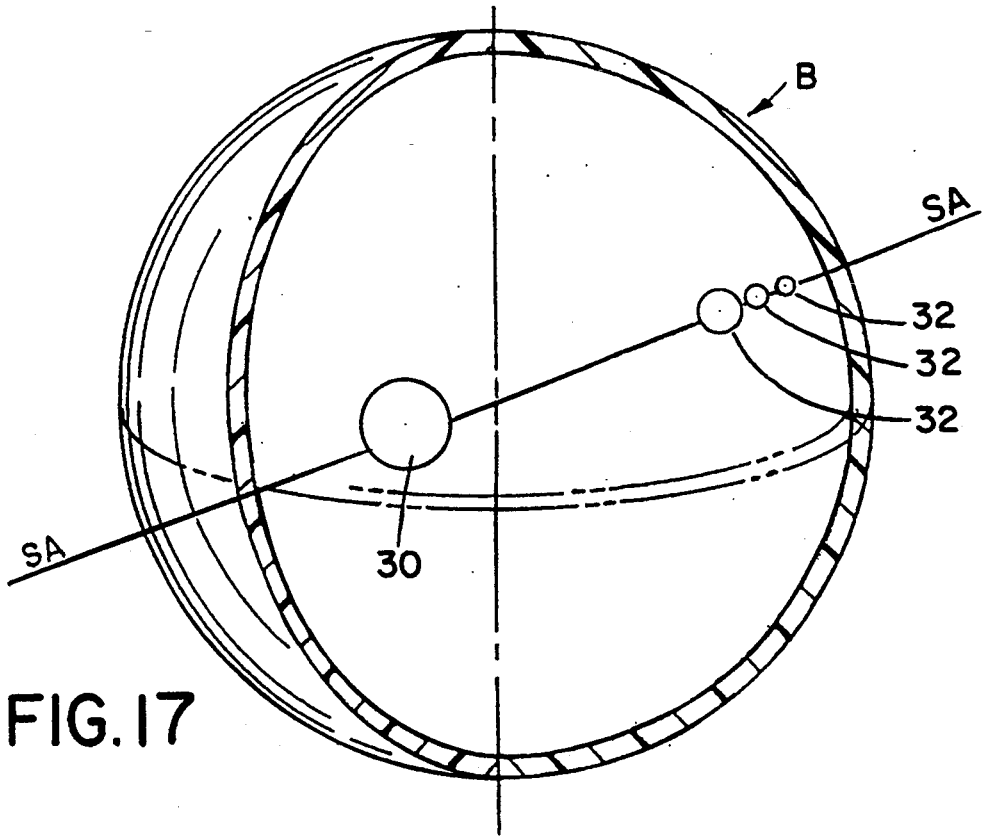

With reference to FIG. 17, alternate embodiments of the invention are shown. In FIG. 17, the weighting means 30, 32 are shown in a spherical configuration in multiple weighting means are utilized.

The invention has been described with reference to a preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A bowling ball, said ball having thumb and finger holes for gripping said ball, said ball having a geometric center and when thrown consistently having a ball track plane and a spin axis, said spin axis being perpendicular to said ball track plane, said ball comprising:

a first weighting means located within said ball along said spin axis on a positive side of said ball, said first weighting means having a weight of $W_1$ and being located a distance $D_1$ from said geometric center; and, a second weighting means located within said ball along said spin axis, said second weighting means having a weight $W_2$ and being located a distance $D_2$ from said geometric center, $W_1$ being greater than $W_2$, $D_1$ being less than $D_2$, said first and second weighting means being on opposite sides of said geometric center along said spin axis, said first and second weighting means placed along said spin axis so that $W_1 D_l = W_2 D_2$.

2. The bowing ball of claim 1 wherein $W_1$ and $W_2$ are greater than 1 ounce.

* * * * *